US011604029B2

(12) United States Patent
Esfehanian

(10) Patent No.: US 11,604,029 B2
(45) Date of Patent: Mar. 14, 2023

(54) CONTAINER, FURNACE AND METHOD FOR HEAT TREATMENT OF A POWDER MIXTURE

(71) Applicant: ONEJOON GMBH, Bovenden (DE)

(72) Inventor: Arian Esfehanian, Böblingen (DE)

(73) Assignee: ONEJOON GMBH, Bovenden (DE)

( * ) Notice: Subject to any disclaimer, the term of this patent is extended or adjusted under 35 U.S.C. 154(b) by 0 days.

(21) Appl. No.: 17/266,302

(22) PCT Filed: Jul. 2, 2019

(86) PCT No.: PCT/DE2019/100614
§ 371 (c)(1),
(2) Date: Feb. 5, 2021

(87) PCT Pub. No.: WO2020/030211
PCT Pub. Date: Feb. 13, 2020

(65) Prior Publication Data

US 2021/0302101 A1 Sep. 30, 2021

(30) Foreign Application Priority Data

Aug. 7, 2018 (DE) ..... 10 2018 119 131.6

(51) Int. Cl.
*F27D 5/00* (2006.01)

(52) U.S. Cl.
CPC ..... *F27D 5/0068* (2013.01); *F27D 5/0012* (2013.01); *F27D 5/0018* (2013.01)

(58) Field of Classification Search
CPC ..... F27D 2003/0012; F27D 2003/0013; F27D 2003/002; F27D 5/0012; F27D 5/00; F27D 5/0006; F22B 1/04; F28C 3/10; F28D 19/02; A47F 7/0007; A47F 7/141; A47B 47/0016; A47B 47/0033; A47B 47/047; A47B 57/48; A47B 57/485; A47B 87/02; A47B 2087/023
See application file for complete search history.

(56) References Cited

U.S. PATENT DOCUMENTS 1,384,468 A * 7/1921 Howell ..... F27D 5/0018 432/259
2,453,511 A * 11/1948 Jackson ..... C21D 9/0025 432/261

(Continued)

FOREIGN PATENT DOCUMENTS

CN 108 120 305 6/2018
DE 29920156 * 1/2000

(Continued)

*Primary Examiner* — Gregory A Wilson
(74) *Attorney, Agent, or Firm* — Schroeder Intellectual Property Law Group, LLC

(57) ABSTRACT

A container for storing a powder mixture during heat treatment in a furnace, a furnace and a method for heat treatment of a powder mixture. The aim of the invention is to specify a container by means of which in particular the throughput per unit of time can be increased and an automatic removal of the container is simplified. This aim is achieved by a plurality of receptacles for releasable fastening of spacers which in the installed state allow contactless stacking of a plurality of containers one above the other.

12 Claims, 7 Drawing Sheets

(56) References Cited

U.S. PATENT DOCUMENTS

| | | | | | |
|---|---|---|---|---|---|
| 2,710,746 | A * | 6/1955 | Menough | C21D 9/0025 | 432/261 |
| 4,008,997 | A * | 2/1977 | Krasl | F27D 5/0012 | 432/258 |
| 4,315,737 | A * | 2/1982 | Elliott | F27D 3/123 | 432/241 |
| 5,176,465 | A * | 1/1993 | Holsted | A47B 87/02 | 403/379.6 |
| 5,411,153 | A * | 5/1995 | Unfried | A47B 87/0215 | 108/180 |
| 5,971,174 | A * | 10/1999 | Strock | A47B 87/008 | 211/186 |
| 6,062,150 | A * | 5/2000 | Sikora | A47B 87/0223 | 108/190 |
| 7,384,264 | B2 * | 6/2008 | Ego | B29C 70/34 | 108/190 |
| 9,714,792 | B2 * | 7/2017 | Sonntag | F27D 5/0006 | |
| 10,815,546 | B2 * | 10/2020 | Guichard | C21D 9/0025 | |
| 2015/0241127 | A1 | 8/2015 | Kiss et al. | | |

FOREIGN PATENT DOCUMENTS

| | | |
|---|---|---|
| DE | 20 2014 100 848 U1 | 5/2014 |
| WO | 92/19778 | 11/1992 |

* cited by examiner

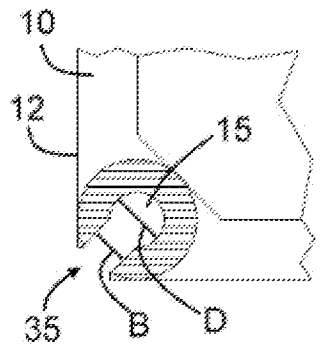
Fig. 4a
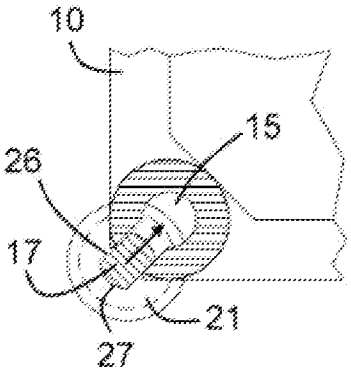
Fig. 4b
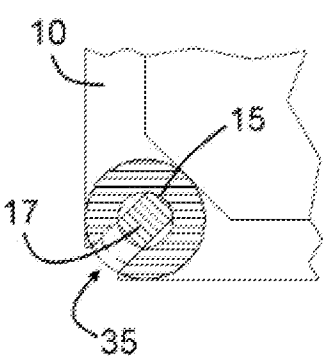
Fig. 4c
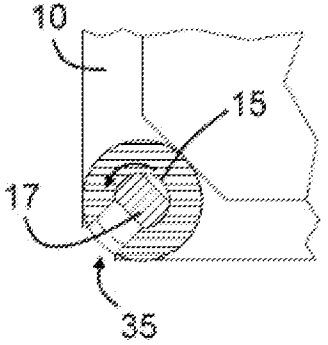
Fig. 4d (y-y)
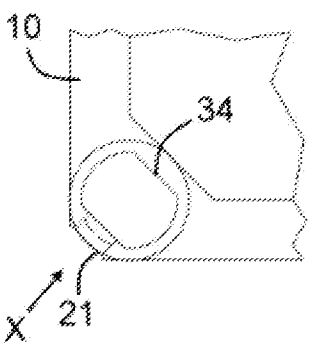
Fig. 4e
Fig. 4f
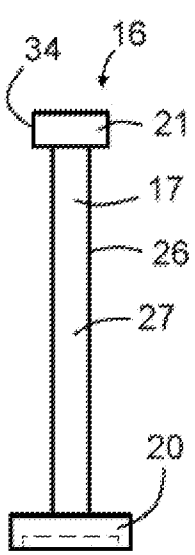
Fig. 4g

CONTAINER, FURNACE AND METHOD FOR HEAT TREATMENT OF A POWDER MIXTURE

RELATED APPLICATIONS

This application is a § 371 national phase of International Patent Application No. PCT/DE2019/100614 filed Jul. 2, 2019, which claims the filing benefit of German Patent Application No. 10 2018 119 131.6 filed Aug. 7, 2018, the contents of both of which are incorporated herein by reference.

FIELD OF THE INVENTION

The present invention relates to a container for storing a powder mixture during heat treatment in a furnace.

The invention furthermore relates to a furnace and to a method for heat treatment of a powder mixture.

BACKGROUND OF THE INVENTION

In many areas of powder chemistry and, especially, in the production of cathode material for batteries, powder mixtures are heat treated in the containers (also referred to as saggars) mentioned at the outset. In this case, the containers are composed of ceramics or of mullitic materials because these materials have good heat resistance and because the containers are exposed to large temperature gradients in the furnace. However, the chemical resistance and mechanical strength of mullitic containers are low, with the result that these containers are sensitive and therefore subject to disadvantages, especially in chemically aggressive atmospheres and in contact with reactive materials.

FIG. 1 shows a typical arrangement of three containers 1 known from the prior art, in each of which a powder bed 4 consisting of a powder mixture is arranged and which are stacked directly one above the other during the firing process in the furnace in order to increase throughput, thus giving rise to contact points 2 at the bottom and top edges of the containers 1. To make it possible, on the one hand, to pass the process gas required for the reaction to the powder mixture and, on the other hand, to discharge waste gases formed within the containers 1 and to enable automatic gripping of each individual container 1 after heat treatment, the containers 1 have recesses 3 which open the interior of the containers 1 to the furnace.

In the case of the lower containers, the stacking of the containers one above the other leads to high mechanical compressive stresses and to a limited service life of the containers because they are deformed and sometimes crack. The quantity of powder per container and consequently the throughput per unit time is therefore limited. Moreover, the combination of pressure, temperature and chemical influences on the containers sometimes leads to at least partial adhesion at the contact points, presenting major problems for the removal of the containers, especially by means of a robot.

SUMMARY OF THE INVENTION

It is therefore the object of the present invention to specify a container, a furnace and a method by means of which the abovementioned problems can be at least partially eliminated. In particular, the intention is to increase the throughput per unit time and to simplify the automatic removal of the containers. Furthermore, the intention is to increase the service life of the containers and effectiveness in the heat treatment of the powder mixture.

This object may be achieved by a container for storing a powder mixture during heat treatment in a furnace, the containers having a plurality of receptacles for releasable fastening of spacers, which in the installed state allow contactless stacking of a plurality of containers one above the other. The object may further be achieved by a furnace for heating a powder mixture in a container designed in the same manner, and a method for heat treating a powder mixture in a container designed in the same manner. According to the invention, this purpose is served by providing a plurality of receptacles for releasable fastening of spacers, which in the installed state allow contactless stacking of a plurality of containers one above the other. In this context, "contactless stacking" should be interpreted to mean that two containers arranged one above the other do not touch and do not form any direct contact points, thereby avoiding the risk of adhesion during the firing process in the furnace. The spacers, which, in contrast, touch each other, are manufactured from a material which is chemically more stable than the containers, and therefore no adhesions occur at the contact points. Because, owing to the contactless stacking, the mass of the containers is no longer supported by the lower containers but, instead, the spacers each perform the supporting function, the mass of each container that has to be supported is reduced to the dead weight and the mass of the powder mixture. It is thereby possible to significantly increase the quantity of powder mixture per container, leading to a significant increase in the throughput per unit time. Moreover, the lower total mass of a container that has to be supported leads to lower mechanical loading and consequently to a significant increase in the service life of the container. Finally, the spaced mounting of the containers relative to one another gives rise to a relatively larger gap between each pair of containers, via which the waste gases due to reactions can be discharged more effectively and via which the process gas can be passed more effectively to the powder mixture. Moreover, the spacing allows more effective heat transfer within the furnace. Outside the furnace, the releasable connection between the containers and the spacer remains until either the containers or the spacer are damaged or worn. In this case, simple manual or automatic exchange by means of the releasable connection is possible.

Preferred embodiments of the present invention are described below.

According to a first preferred embodiment of the invention, it is envisaged that the container is bounded by a lateral wall having a bottom edge and a top edge, which has a plurality of receptacles to receive the spacers, said receptacles passing through the wall from the bottom edge to the top edge, wherein the container is preferably of one-piece configuration. In the present case, a one-piece configuration should be interpreted to mean that the container does not consist of loose wall elements or wall elements that can be released from one another and of a bottom element but that the container with the walls and a bottom is manufactured in one piece. Preferably, the container is of rectangular cross section, and the receptacles are inserted in the corners of the wall. In this case, essentially two different types of receptacles are provided. First of all, the receptacles can be closed in the radial direction, whereby the receptacles are inserted fully into the wall of the containers and the wall opens only at the top edge and at the bottom edge. Alternatively, the receptacles can have lateral openings with an opening width in the radial direction. The receptacles can have an essentially arbitrary cross section, in particular an angular, rectangular or round cross section. If the receptacles are designed as holes with a round cross section, the opening widths of the lateral openings are smaller than the inside diameter of the holes.

The receptacles allow the releasable reception of the spacers, which each have a support and a) a foot or a foot portion and/or b) a head or a head portion, wherein the support can in each case be inserted into a receptacle of the container. The foot and/or the head of a spacer is of widened configuration relative to the associated support. In contrast, the foot portion and/or the head portion is not of widened configuration and merges, preferably continuously, into the support. In the simplest case, the support is merely elongated to form a head portion and/or a foot portion. The supports are of substantially cylindrical design and are matched in cross section and height to the receptacles within the container. In particular, it is envisaged that the spacers project beyond the wall of the container at the top edge and at the bottom edge in the installed state, and can be locked within the receptacles.

The feet or foot portions and the heads or head portions are arranged on those portions of the supports which project beyond the wall. By virtue of the spacers/supports extending through the entire wall, the containers rest exclusively on the spacers, and therefore the lowermost spacers support the mass of all the containers and spacers arranged thereabove.

Various preferred embodiments of spacers are provided. Here, a first preferred configuration envisages that the support of a spacer is of two-piece design, and has a lower support part having a foot and can be inserted into the hole at the bottom edge of the wall. An upper support part has a head and can be inserted into the hole at the top edge of the wall. The lower and the upper support part can be connected releasably to one another within the hole to lock the spacer. To connect the support parts within the hole, it is possible, for example, to provide a threaded connection with corresponding thread portions or a bayonet connection.

As an alternative to a two-piece configuration of the spacers, the supports of the spacers can be of one-piece design and can be lockable within a hole. A spacer having a support, a widened foot and a head portion or a spacer having a support, a widened head and a foot portion can be locked within the hole, preferably by means of a cotter pin, a latching connection or comparable fastening means.

A spacer having a one-piece support, or a head and a foot can have a screwed connection by means of corresponding thread portions on the support and on the head and/or on the foot to provide mounting in the hole in a manner which is releasable and, at the same time, secure against loss.

All the variant embodiments described allow simple and problem-free insertion of the supports into the holes and simple locking therein.

It has already been mentioned that the holes can also have lateral openings which extend parallel to the longitudinal axis of the holes and open laterally, passing through the wall of the hole. Such holes are used for the releasable connection of spacers, the supports of which each have two parallel guide surfaces, which are connected to one another by partially cylindrical sliding surfaces, with the result that the supports can be inserted into the holes through the lateral openings of the holes and are mounted therein by positive engagement by rotation of the supports around the longitudinal axis. For this purpose, the opening width of the lateral opening of the holes is matched to the distance between the sliding surfaces of the supports. In the installed state, the supports are mounted by positive engagement within the holes, and the partially cylindrical sliding surfaces rest against the inner walls of the holes. With this version of the fastening, it is also possible to use spacers whose one-piece supports are connected permanently to the feet and heads.

To promote stable mounting of the containers in the stacked state, it is envisaged according to a preferred configuration of the invention that a) the head or the head portion of the spacers, and b) the foot or the foot portion of the spacers have corresponding recesses and raised portions on the ends, thus blocking sideways displacement of the container in the stacked state. In the simplest case, such recesses and raised portions can be annular or circular grooves and keys which form a plug-in connection between two spacers arranged one above the other.

The spacers, in particular the supports and/or the heads and/or the feet, are preferably composed of high-strength and dense high performance ceramics, in particular of alumina ($Al_2O_3$), which preferably has a porosity of less than 5%. As a result, the spacers are of significantly more stable configuration chemically and mechanically than the containers produced from ceramics or mullitic material.

Further preferred configurations and specific embodiments of the invention are explained below and with reference to the figures, of which:

BRIEF DESCRIPTION OF THE DRAWINGS

FIGS. 4*a-e* show detail views of containers having laterally open receptacles, FIGS. 4*f, g* show cross-sectional illustrations of a spacer.

DETAILED DESCRIPTION OF THE PRESENT INVENTION

Figure 1:
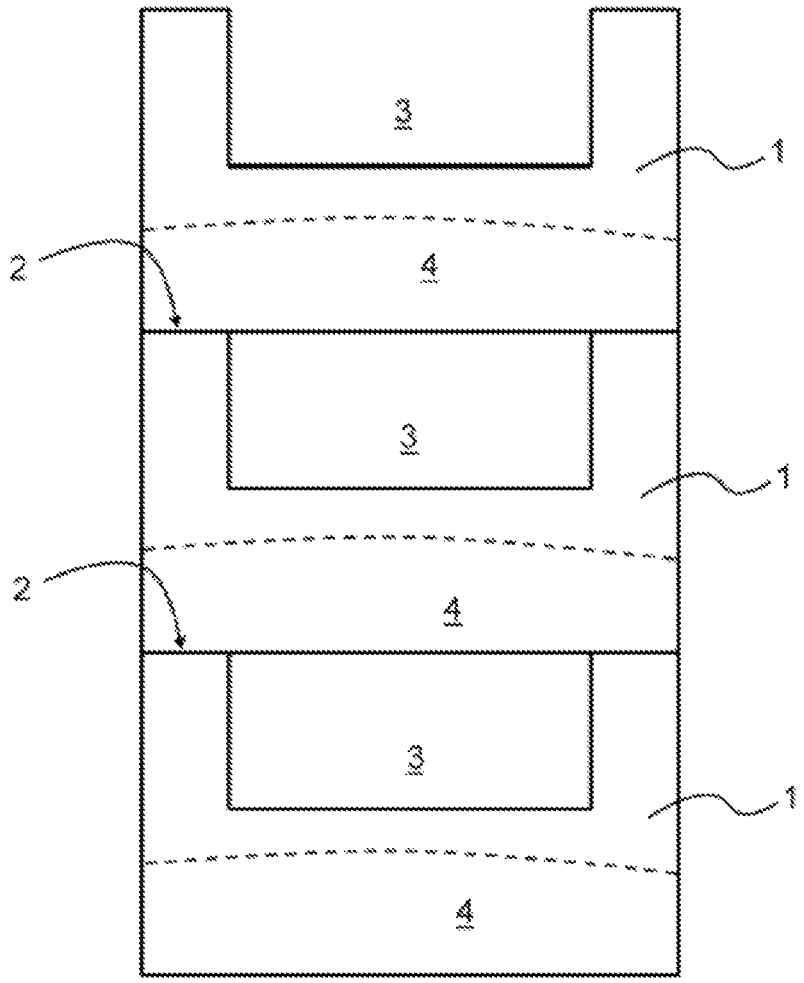
Fig. 1 (Prior Art)
FIG. 1 shows a stack comprising three containers according to the prior art, FIGS. 2*a, b* show containers having two-piece spacers, FIGS. 3*a, b* show detail views of containers having one-piece spacers.
Figure 2A:
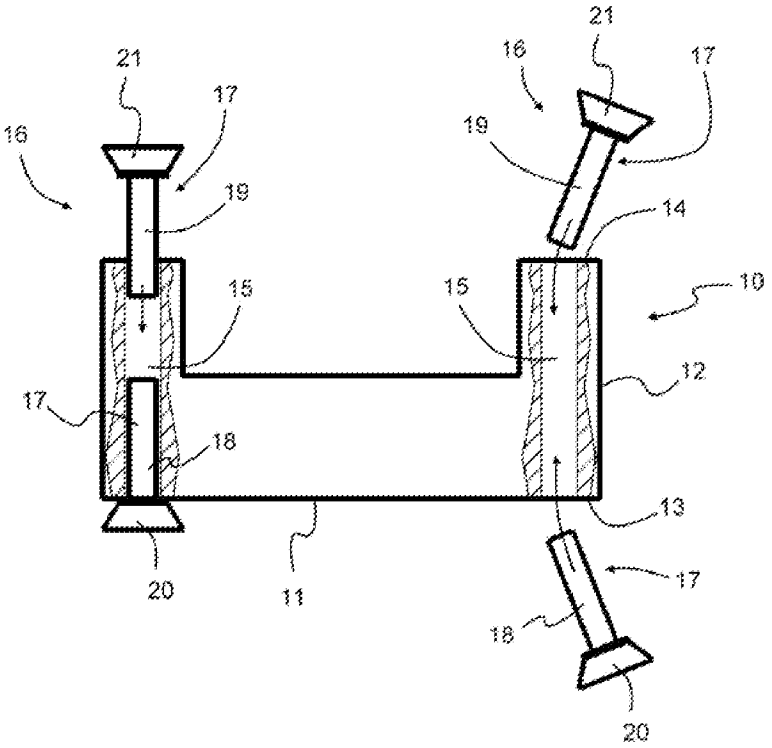

A first illustrative embodiment of the invention is illustrated in FIGS. 2*a, b*. The containers 10 shown therein are each of one-piece configuration and have a bottom 11 and a wall 12, and therefore the containers 10 are of dish-shaped design to receive a powder mixture. The wall 12 has a bottom edge 13 and a top edge 14 and, between said edges, is penetrated by receptacles in the form of holes 15. The holes 15 serve to receive a spacer 16, which, in the illustrative embodiment shown, is of two-piece design and has a support 17 consisting of a lower support part 18 and an upper support part 19. The lower support part 18 is connected to a foot 20, while the upper support part 19 is connected to a head 21. In order to connect the spacer 16 releasably to the container 10, the lower support part 18 is inserted from below into a hole 15. The upper support part 19 is inserted into the hole 15 at the top edge 14 until the upper and lower support parts 18, 19 strike against one another. There, the support parts 18, 19 can be connected releasably to one another by means of suitable releasable connection means, e.g. by means of a screwed connection or by means of a bayonet connection. After the spacers 16 have been fastened, a plurality of containers 10 can be stacked one above the other without the containers 10 touching and forming contact points in the process.

Figure 2B:
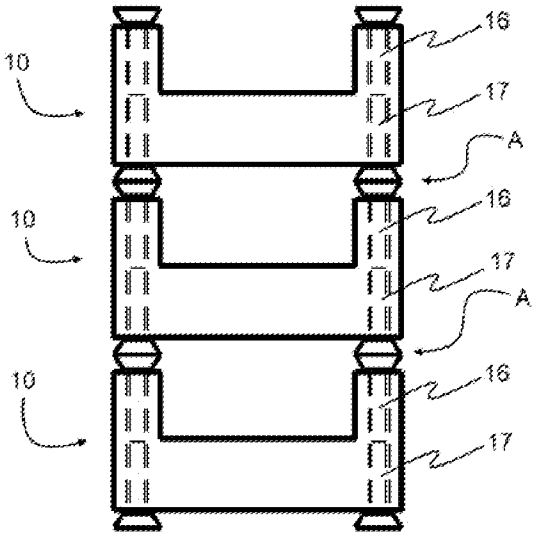

FIG. 2*b* shows a stack of three containers 10 according to the invention, between which there is a larger spacing A than that in the prior art for feeding in process gas and discharging gases stemming from reactions. It is furthermore already clearly apparent from FIG. 2*b* that the total mass of all the containers 10 is supported by the spacers 16 because they pass completely through the holes 15 of the containers 10. Consequently, the lowermost container 10 supports only its own mass and therefore not the mass of the containers 10 arranged thereabove.

Figure 3B:
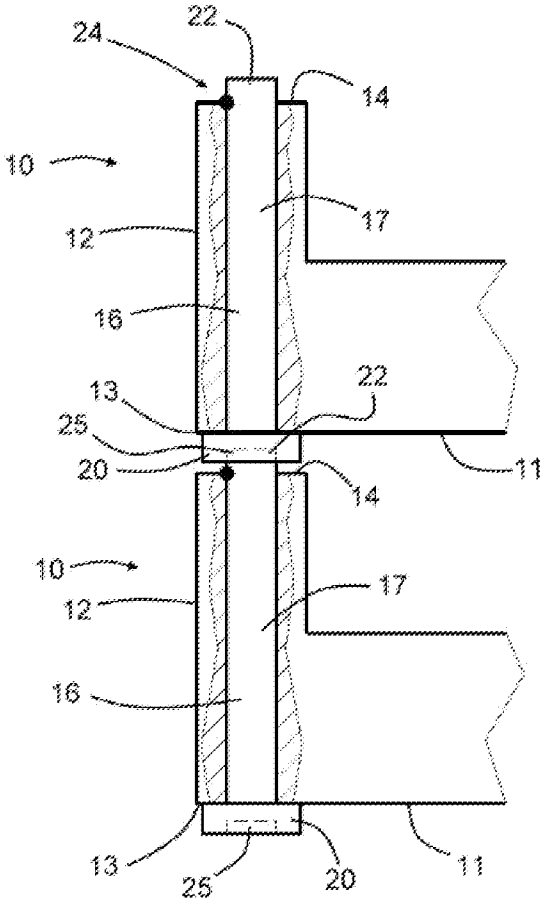
Figure 3A:
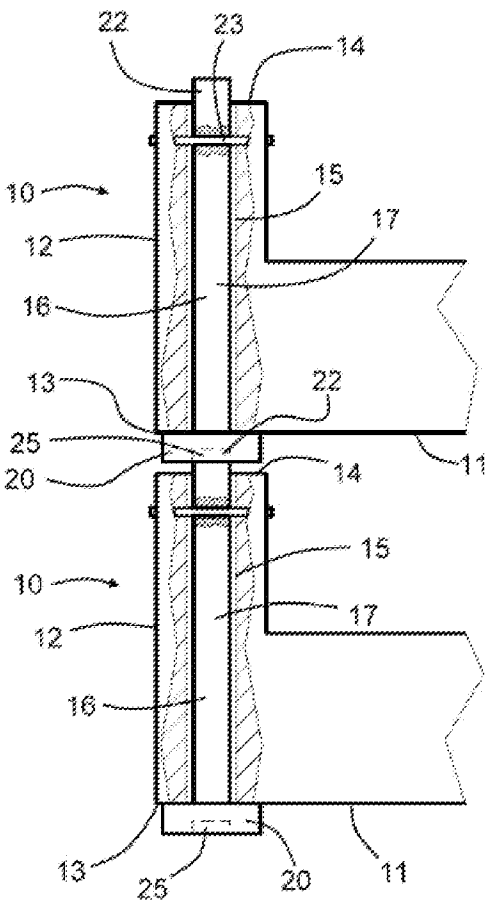

FIGS. 3*a* and *b* show further alternative configurations of containers 10 having spacers 16 arranged in a laterally closed hole 15. In both illustrative embodiments, the spacer 16 is inserted into the hole 15 at the bottom edge 13 until the foot 20 arranged on the support 17 strikes against the bottom 11 of the containers 10. In this position, the support 17 of the spacer 16 projects beyond the top edge 14 of the containers 10 and consequently forms a head portion 22 because the support 17 is not connected there to a separate and widened head. In this position, the spacer 16 is fastened with a cotter pin 23 according to FIG. 3*a* and with a latching connection 24 according to FIG. 3*b*. In the stacked state of the containers 10, the head portion 22 of the support 17 engages in a recess 25 in the foot 20, thus preventing sideways displacement by means of a positive plug-in connection. In this arrangement, the transverse holes for receiving the cotter pin 23 within the wall 12 and/or within the support 17 are of a size such that no force is exerted on the wall of the containers 10 in the stacked state. The cotter pin 23 merely prevents the spacer 16 or support 17 from sliding out of the receptacle when a container 10 is raised.

As an alternative to the configuration shown in FIGS. 3*a, b*, the support 17 can also be inserted into the hole 15 of the containers 10 at the top edge 14, and therefore the spacer 16 has a head 21 and a foot portion which projects at the bottom edge 13 of the containers 10. In other respects, the mode of operation of this alternative configuration is similar to the mode of operation shown in FIGS. 3*a* and 3*b*.

Figure 4H:
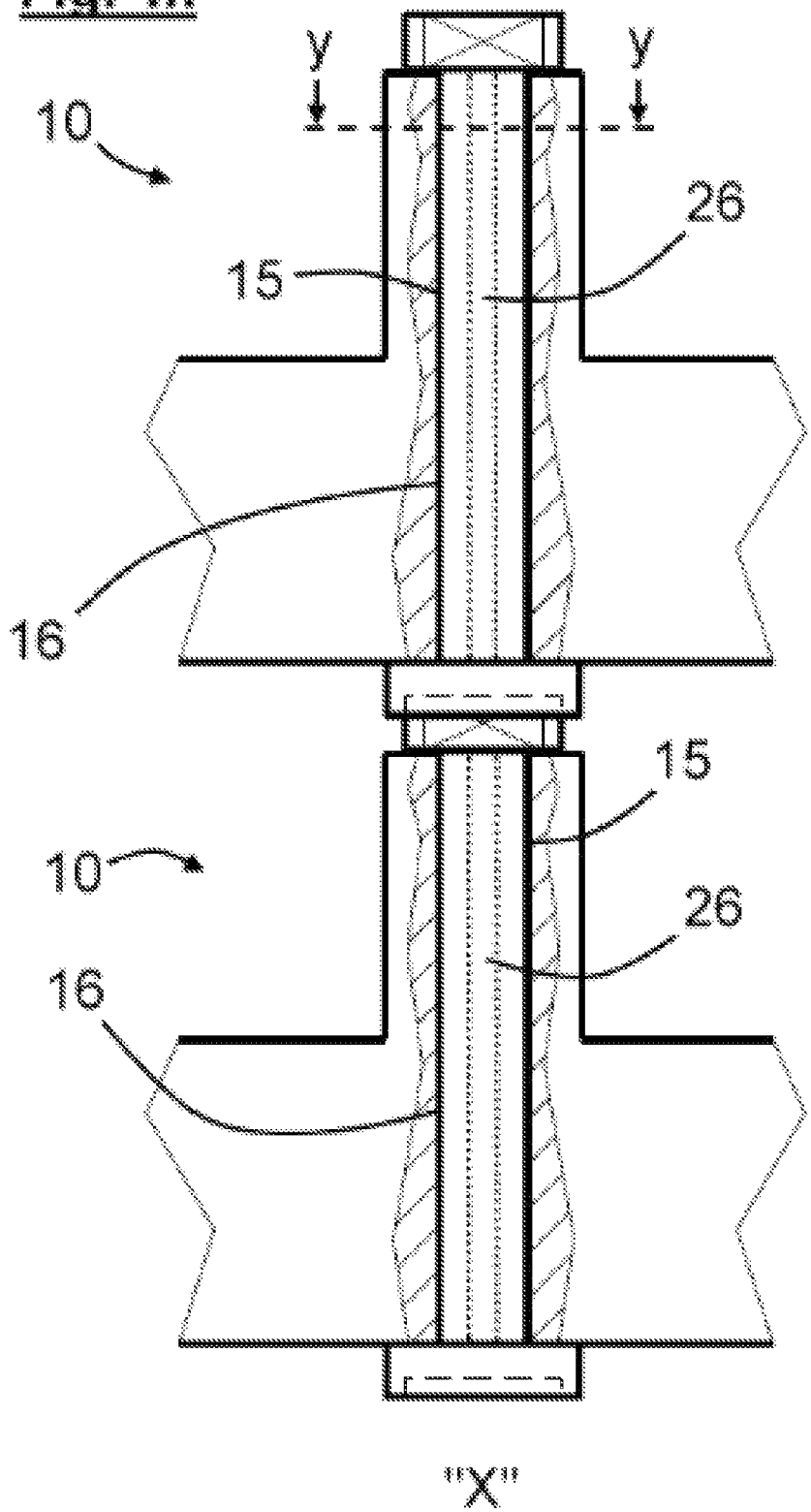
FIG. 4*h* shows detail views of stacked containers, and FIGS. 5*a, b* show cross-sectional illustrations of a furnace with containers.

FIGS. 4*a-h* show an alternative configuration of containers 10 to that in FIGS. 2*a, b* and 3*a, b*, with a lateral opening 35 of the receptacle, which is designed as a hole 15. FIG. 4*a* shows a container 10 in plan view, in the wall 12 of which a hole 15 is introduced. The hole 15 is open to the side and has an opening width B which is less than the diameter D of the hole 15. A support 17 of a spacer 16, as illustrated in FIGS. 4*f* and 4*g*, can be inserted laterally into such a hole 15. The spacer 16 illustrated has a head 21 and a foot 20, which are connected to one another by the support 17. The support 17 has parallel guide surfaces 26, which are connected to one another by partially cylindrical sliding surfaces 27. Here, the guide surfaces 26 are spaced apart to such an extent that they allow the insertion of the support 17 into the hole 15, this being illustrated in particular in FIGS. 4*b* and 4*c*. As soon as the support 17 is completely within the hole 15 (FIG. 4*c*), the spacer 16 is locked within the hole 15 by rotating the support 17 around the longitudinal axis (FIGS. 4*d, e*). To enable the spacers 16 to be rotated, parallel wrench engagement surfaces 34 are formed on the head 21, forming a contact surface for a screwing tool. The use of laterally open holes 15 allows the use of one-piece spacers 16 which not only have a one-piece support 17 but are also connected integrally to the head 21 and the foot 20.

The spacers 16 can be inserted into the receptacles and locked therein manually or automatically by means of a robot.

FIG. 4*h* shows a detail view of stacked containers 10, which are each connected to a spacer 16 having lateral guide surfaces 26 that rest in laterally open holes 15 and are locked therein by positive engagement.

Figure 5A:
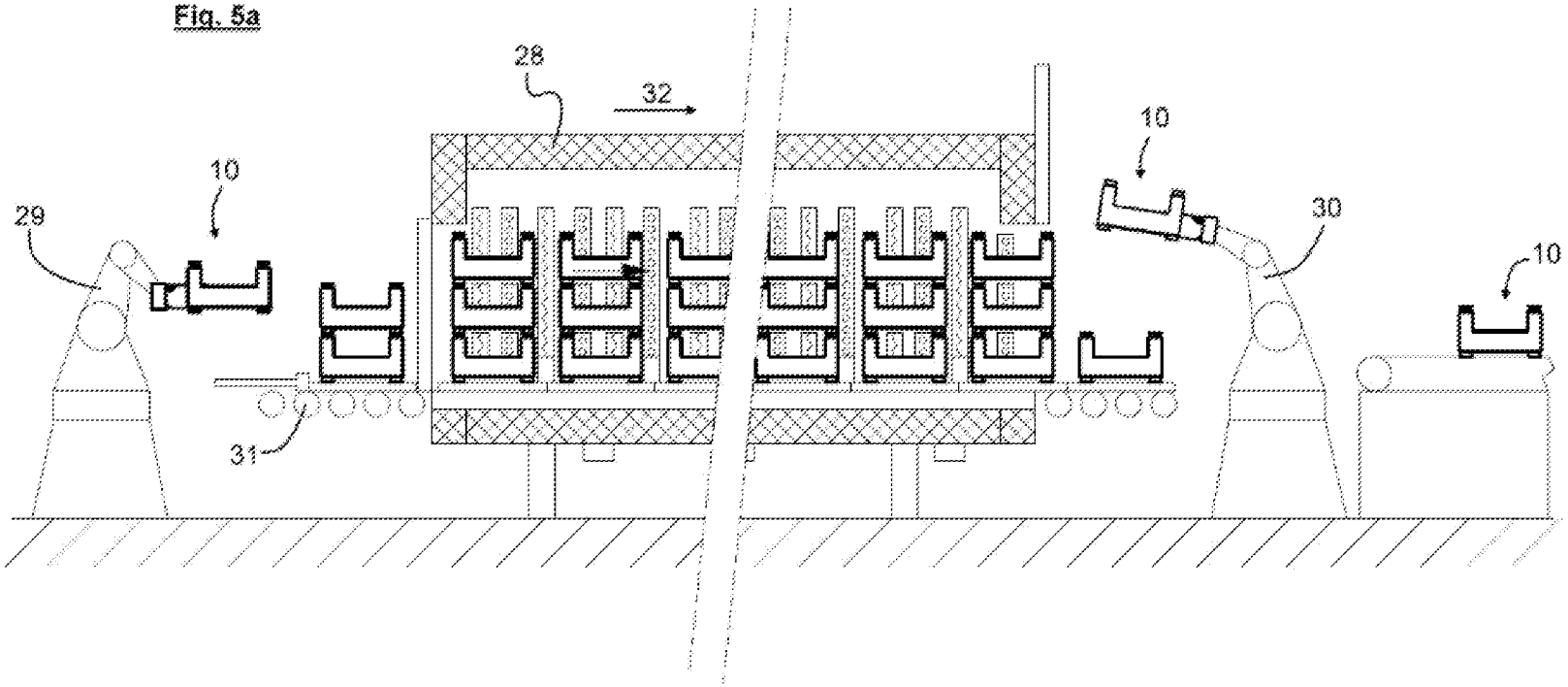

FIG. 5*a* illustrates the automatic charging of a furnace 28 with containers 10 and the automatic removal of the containers 10 by respective robots 29, 30. On the left-hand side of the furnace 28 there is a first robot 29, which stacks a plurality of containers 10 filled with a powder mixture one above the other. Respective groups of three stacked containers 10 are then inserted into the furnace 28 in transfer direction 32 by a suitable transfer device 31. There, the powder mixture is heat treated in accordance with the specified processes before each container 10 is picked up individually by a further robot 30 on the right-hand side of the furnace 28 and taken for onward transfer.

Figure 5B:
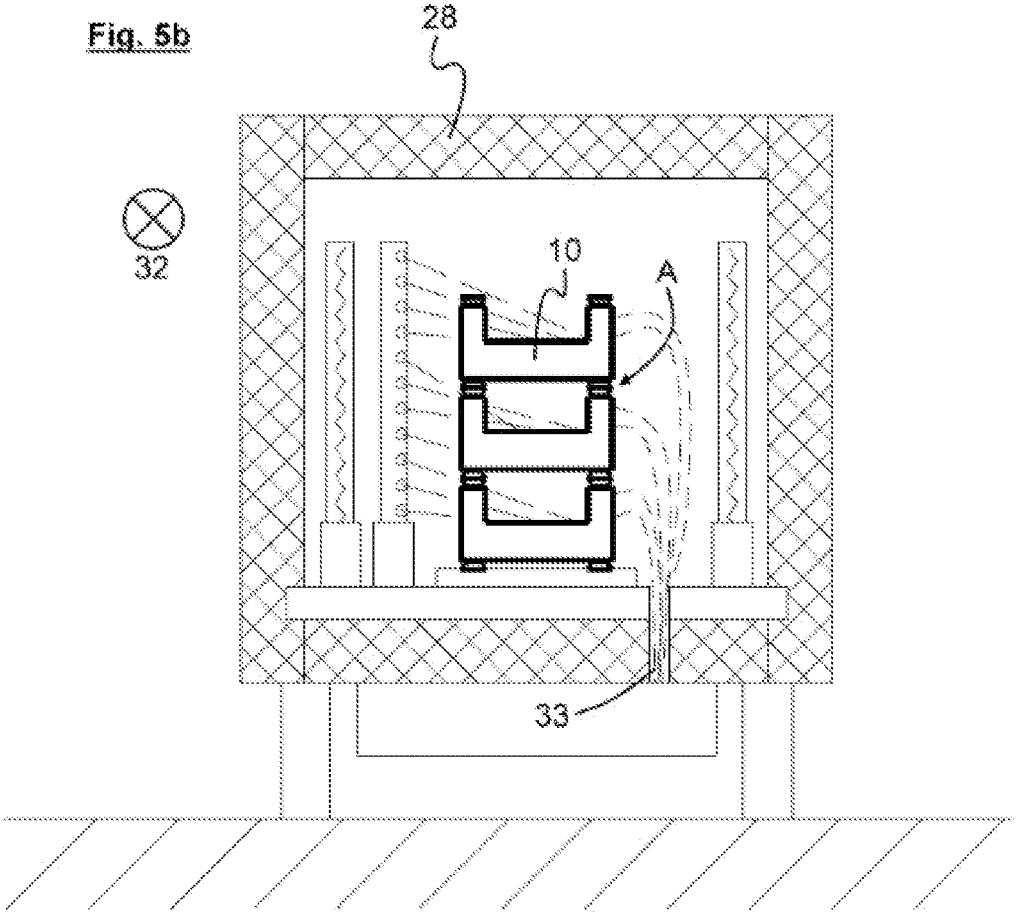

FIG. 5*b* shows a cross section of the furnace 28 in transfer direction 32 and illustrates the advantages of the spaced mounting of the containers 10 because there is a relatively large spacing A between them by virtue of the spacers 16, and therefore process gases can be fed in effectively and any reaction gases can be discharged effectively through a corresponding opening 33 at the bottom or in the wall of the furnace 28. Moreover, the relatively large spacing A results in more effective heat treatment.

| List of reference signs | |
|---|---|
| 1 | Container |
| 2 | Recess |
| 3 | Contact point |
| 4 | Powder bed |
| 10 | Container |
| 11 | Bottom |
| 12 | Wall |
| 13 | Bottom edge |
| 14 | Top edge |
| 15 | Hole |
| 16 | Spacer |
| 17 | Support |
| 18 | Lower support part |
| 19 | Upper support part |
| 20 | Foot |
| 21 | Head |
| 22 | Head portion |
| 23 | Cotter pin |
| 24 | Latching connection |
| 25 | Recess |
| 26 | Guide surfaces |
| 27 | Sliding surfaces |
| 28 | Furnace |
| 29 | Robot |
| 30 | Robot |
| 31 | Transfer device |
| 32 | Transfer direction |
| 33 | Opening |
| 34 | Wrench engagement surface |
| 35 | Lateral opening |
| A | Spacing |
| B | Opening width |
| D | Diameter |

What is claimed is:

1. A container for storing a powder mixture during heat treatment in a furnace, comprising:

a lateral wall having a bottom edge and a top edge bounding the container, wherein the lateral wall comprises a plurality of receptacles passing through the lateral wall from the bottom edge to the top edge for releasable fastening of spacers, which in an installed state allow contactless stacking of a plurality of containers one above the other, in that the spacers project beyond the lateral wall of the container at the top edge and the bottom edge in the installed state, and can be locked within the receptacle.

2. The container as claimed in claim 1, wherein the container is of one-piece configuration.

3. The container as claimed in claim 1, wherein the plurality of receptacles are of closed design in the radial direction or have lateral openings with an opening width B in the radial direction.

4. The container as claimed in claim 1, wherein the spacers each have a support and a) a foot or a foot portion and/or b) a head or a head portion, wherein the support can in each case be inserted into a receptacle from the plurality of receptacles of the container.

5. The container as claimed in claim 4, wherein the support is of two-piece design, and has a) a lower support part having the foot, which can be inserted into the receptacle at the bottom edge of the lateral wall, as well as b) an upper support part having the head, which can be inserted into the receptacle at the top edge of the lateral wall, wherein the lower and the upper support part can be connected releasably to one another within the receptacle to lock the spacer.

6. The container as claimed in claim 4, wherein the support of each spacer is of one-piece design and can be locked within the receptacles, wherein a cotter pin, a latching connection or a screwed connection from the support to the foot or to the head is provided for locking.

7. The container as claimed in claim 4, wherein each support has two parallel guide surfaces, which are connected to one another by partially cylindrical sliding surfaces, with the result that the supports can be inserted into the lateral openings of the receptacles and are mounted by positive engagement therein by rotation of the supports around the longitudinal axis.

8. The container as claimed in claim 4, wherein a) the head or the head portion of the spacers, and b) the foot or the foot portion of the spacers have corresponding recesses and raised portions on the ends, thus blocking sideways displacement of the container in the stacked state.

9. The container as claimed in claim 4, wherein one or more of the spacers, the supports, the heads, and/or the feet, are composed of alumina.

10. The container as claimed in claim 9, wherein the alumina has a porosity of less than 5%.

11. A furnace for heat treating a powder mixture in a container, wherein the container is designed as claimed in claim 1.

12. A method for heat treating a powder mixture in a container, wherein the container is designed as claimed in claim 1.

* * * * *